US012144481B2

(12) United States Patent
Grasiani et al.

(10) Patent No.: US 12,144,481 B2
(45) Date of Patent: Nov. 19, 2024

(54) RECONFIGURABLE THREE DIMESIONAL LATTICE FOR SUPPORTING LIQUID FILMS

(71) Applicant: S&R INNOVATIVE CONCEPTS, LLC, Fort Lauderdale, FL (US)

(72) Inventors: Yehoshua Grasiani, Fort Lauderdale, FL (US); Ron Weizman, Fort Lauderdale, FL (US)

(73) Assignee: S&RINNOVATIVE CONCEPTS, LLC, Fort Lauderdale, FL (US)

( * ) Notice: Subject to any disclaimer, the term of this patent is extended or adjusted under 35 U.S.C. 154(b) by 317 days.

(21) Appl. No.: 17/743,244

(22) Filed: May 12, 2022

(65) Prior Publication Data

US 2023/0363618 A1 Nov. 16, 2023

(51) Int. Cl.
*A63H 33/28* (2006.01)
*A47L 15/44* (2006.01)

(52) U.S. Cl.
CPC ..... *A47L 15/4418* (2013.01); *A63H 33/28* (2013.01)

(58) Field of Classification Search
CPC ..... A47L 15/4418; A63H 33/28
USPC ..... 446/102, 116, 15–21
See application file for complete search history.

(56) References Cited

U.S. PATENT DOCUMENTS

| | | | | |
|---|---|---|---|---|
| 1,330,701 | A | 2/1920 | Gilchrist | |
| 1,344,104 | A | 6/1920 | Tyrrell | |
| 3,830,011 | A * | 8/1974 | Ochrymowich | A63H 33/102 446/107 |
| 4,149,337 | A * | 4/1979 | Habisohn | A63H 33/28 131/198.1 |
| 4,152,864 | A * | 5/1979 | Habisohn | A63H 33/28 446/15 |
| 4,274,222 | A * | 6/1981 | Zahn | A63H 33/102 52/DIG. 10 |
| 33,785 | A | 12/1991 | Hildebrandt et al. | |
| 6,840,699 | B2 | 1/2005 | Rogers et al. | |
| 7,900,646 | B2 * | 3/2011 | Miller | E04H 15/44 52/645 |
| 2013/0095901 | A1 * | 4/2013 | Houlis | G09B 23/00 463/9 |

FOREIGN PATENT DOCUMENTS

| | | | | |
|---|---|---|---|---|
| WO | WO-9304750 A1 * | 3/1993 | | A63H 33/10 |
| WO | WO-2015058124 A1 * | 4/2015 | | A63H 33/102 |

* cited by examiner

*Primary Examiner* — Nini F Legesse
(74) *Attorney, Agent, or Firm* — The Roy Gross Law Firm, LLC; Roy D. Gross

(57) ABSTRACT

A reconfigurable three-dimensional lattice in and on which detergent solutions and other liquid films may be deposited and supported, wherein the lattice may be configured and reconfigured for use, cleaning, and storage.

19 Claims, 15 Drawing Sheets

100

RECONFIGURABLE THREE DIMESIONAL LATTICE FOR SUPPORTING LIQUID FILMS

FIELD OF THE INVENTION

The present invention relates to a reconfigurable three-dimensional lattice for supporting liquid films.

More specifically, the present invention relates to a reconfigurable three-dimensional lattice in and on which detergent solutions and other liquid films may be deposited and supported, wherein the lattice may be configured and reconfigured for use, cleaning, and storage.

BACKGROUND OF THE INVENTION

In the 1730s, artist Jean Simeon Chardin painted "*Soap Bubbles*", which captures a young man blowing a bubble with a rod or wand while leaning out a window.

An 1882 book, "*The American Boys Handy Book: What to do and How to do it*", by D. C. Beard, has a chapter entitled "*Novelties in Soap-Bubbles.*"

A very well-known modern piece by Sir John Everett Millais (circa 1886) entitled "*Bubbles*" (originally "*A Child's World*") became a famous advertisement for Pear's soap.

U.S. Pat. No. 1,330,701 granted to John. L Gilchrist and entitled "*Bubble-pipe*" discloses a system which "may be cheaply manufactured and in which the parts are so associated that they may be disassembled and cleaned and quickly reassembled by an unskilled person."

U.S. Pat. No. 1,344,104 granted to Claude U. Tyrell and entitled "*Bubble-blower*" includes a reservoir for bubble solution.

Today, a myriad of bubble-generating systems include; large rings, bubble pistols bubble machines for stage and entertainment, bubble lawnmowers, and the like.

An optimal film for bubbles comes from an optimal solution. Most recipes involve liquid detergents and water. Unlike soaps; detergents don't contain a carboxylate group that reacts with calcium and magnesium ions found in hard water; therefore, detergents are not dependent on distilled water for bubble formation.

Typically, a novelty "soap bubble formulation" produces a spherical layer of soap film encapsulating air or gas. The film consists of a thin sheet of water sandwiched between two layers of soap/detergent molecules. One end of each soap molecule being hydrophilic, i.e. attracted to water; the other end hydrophobic and tends to avoid water. The hydrophobic ends of the molecules crowd to the surface, trying to avoid the water, point out away from the layer of water molecules. As a result, water molecules separate from each other. The increased distance between the water molecules causes a decrease in surface tension, enabling bubbles to form.

Bubbles take their familiar spherical shape in order to minimize the energy or forces of the molecules of the film. A sphere provides the minimal surface area needed to enclose a given volume, making it the most efficient shape for a bubble; naturally so.

Glycerin, C3H5(OH)3, is often included in "bubble solutions". Bubbles eventually burst once the inner layer of water evaporates. Glycerin forms weak hydrogen bonds with water and delays water evaporation which extends bubble duration.

Toronto based Spin Master Toys' Catch-A-Bubble™ takes bubble strengthening to the extreme. Invented by "bubble solution expert" Jackie Lin, the trade-secret solution contains polymers which allows bubbles to resist evaporation for long periods. The polymer hardens three to four seconds after bubble formation; and if left undisturbed can last for days.

Minimal Surface Shapes

Bubbles tend to come in predictable shapes because deformation a bubble takes energy. Bubbles tend to spring back to the shape that is stretched as little as possible—the minimum surface area. Floating in the air, a bubble will become a sphere, because a sphere has the least surface area for a given volume of air. Another way to think about this is that the bubble is stretched most evenly as a sphere (as compared to an egg shape, or a cube). A shape with corners or edges means that the soap is stretched unevenly.

As may be appreciated; prior to "active bubble" formation using a ring-in-cap bottle system, a film of bubble solution is loaded into the ring. The ring functions as a framework to hold the solution for "active bubble" formation; that is blowing through the ring to form . . . bubbles. Typically, a "bubble wand" aperture is round; however, some systems include square, star, or other shape openings which may be sales-attractive to child and child-like system users.

Released for public sale in June 2018; the manufacturer Toysmith 4M® Educational Toys produces KidzLabs Bubble Science Kit, Model: 5591, which includes fixed cube and triangle shaped lattice(s) in and on which detergent solution films and bubbles may be supported. From the Product Description:

"Explore the wobbly science of bubble making with the 4M Bubble Science Kit. The experiments in this kit include creating an unbreakable bubble, a giant bubble, a bubble film, and more. This kit includes a variety of bubble-making frames to experiment with different bubble sizes and shapes. Includes recipes to make your own high-quality bubble mixture.".

However, there are no known systems nor methods wherein a user may modify or build lattices (structures) of various configurations for craft, entertainment, and learning purposes.

What is desired is to provide a system, method, and kit including reconfigurable lattice in and on which detergent solutions and other films may be deposited and supported.

What is desired is to provide a system, method, and kit including reconfigurable lattice in and on which detergent solutions and other liquid films may be deposited and supported, wherein the lattice may be configured and reconfigured for use, cleaning, and storage.

SUMMARY OF THE INVENTION

It is an object of the instant invention to provide a modular system of creating bubbles.

It is an object of the instant invention to provide a reconfigurable three-dimensional lattice system comprising; at least six rods, each rod having an aperture at and in each opposing end; and at least four flexible corner connectors each having three posts, each post having a longitudinal axis and configured to be received into the aperture in and at one end of one of the at least six rods; whereby when the at least six rods and the at least four corner connectors are assembled by a user provide a three-dimensional lattice upon which a liquid film may be deposited and supported.

It is an object of the instant invention to provide a reconfigurable three-dimensional lattice system, wherein an at least four flexible corner connector post longitudinal axis is configured approximately one-hundred-and-twenty degrees from the longitudinal axis of an adjacent post.

It is an object of the instant invention to provide a reconfigurable three-dimensional lattice system, wherein an at least four flexible corner connector post longitudinal axis is configured approximately greater than one-hundred-and-twenty degrees from the longitudinal axis of an adjacent post.

It is an object of the instant invention to provide a reconfigurable three-dimensional lattice system, wherein the corner connectors and cylindrical rods comprise a plastic.

It is an object of the instant invention to provide a reconfigurable three-dimensional lattice system, wherein the flexible corner connectors are identical in size and configuration and the cylindrical rods are of equal length.

It is an object of the instant invention to provide a reconfigurable three-dimensional lattice system, wherein the corner connectors and rods when assembled provide a four-sided or tetrahedral shaped lattice.

It is an object of the instant invention to provide a reconfigurable three-dimensional lattice system, wherein the corner connectors and rods when assembled provide a six-sided or cube shaped lattice.

It is an object of the instant invention to provide a reconfigurable three-dimensional lattice system, wherein the corner connectors and rods when assembled provide a lattice of more than six sides.

It is an object of the instant invention to provide method of assembling a reconfigurable three-dimensional lattice system comprising the steps of; providing at least six rods, each rod having an aperture at and in each opposing end; and providing at least four flexible corner connectors each having three posts, each post having a longitudinal axis and configured to be received into the aperture in and at one end of one of the at least six rods; whereby when the at least six rods and the at least four corner connectors are assembled by a user provide a three-dimensional lattice upon which a liquid film may be deposited and supported.

It is an object of the instant invention to provide method of assembling a reconfigurable three-dimensional lattice system, wherein an at least four flexible corner connector post longitudinal axis is configured approximately one-hundred-and-twenty degrees from the longitudinal axis of an adjacent post.

It is an object of the instant invention to provide method of assembling a reconfigurable three-dimensional lattice system, wherein an at least four flexible corner connector post longitudinal axis is configured approximately greater than one-hundred-and-twenty degrees from the longitudinal axis of an adjacent post.

It is an object of the instant invention to provide method of assembling a reconfigurable three-dimensional lattice system, wherein the corner connectors and cylindrical rods comprise a plastic.

It is an object of the instant invention to provide method of assembling a reconfigurable three-dimensional lattice system, wherein the flexible corner connectors are identical in size and configuration and the cylindrical rods are of equal length.

It is an object of the instant invention to provide method of assembling a reconfigurable three-dimensional lattice system, wherein the corner connectors and rods when assembled provide a four-sided or tetrahedral shaped lattice.

It is an object of the instant invention to provide method of assembling a reconfigurable three-dimensional lattice system, wherein the corner connectors and rods when assembled provide a six-sided or cube shaped lattice.

It is an object of the instant invention to provide method of assembling a reconfigurable three-dimensional lattice system, wherein the corner connectors and rods when assembled provide a lattice of more than six sides.

It is an object of the instant invention to provide a kit for assembling a reconfigurable three-dimensional lattice upon which a liquid film may be deposited and supported, the kit comprising; at least six rods, each rod having an aperture at and in each opposing end; and at least four flexible corner connectors each having three posts, each post having a longitudinal axis and configured to be received into the aperture in and at one end of one of the at least six rods; whereby when the at least six rods and the at least four corner connectors are assembled by a user provide a three-dimensional lattice upon which a liquid film may be deposited and supported.

It is an object of the instant invention to provide a kit for assembling a reconfigurable three-dimensional lattice upon which a liquid film may be deposited and supported, wherein an at least four flexible corner connector post longitudinal axis is configured approximately one-hundred-and-twenty degrees from the longitudinal axis of an adjacent post.

It is an object of the instant invention to provide a kit for assembling a reconfigurable three-dimensional lattice upon which a liquid film may be deposited and supported, wherein an at least four flexible corner connector post longitudinal axis is configured approximately greater than one-hundred-and-twenty degrees from the longitudinal axis of an adjacent post.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

In the following description, numerous details are set forth for the purpose of explanation and example. However, one of ordinary skill in the art will realize that the invention may be practiced without the use of these specific details.

Figure 1A:
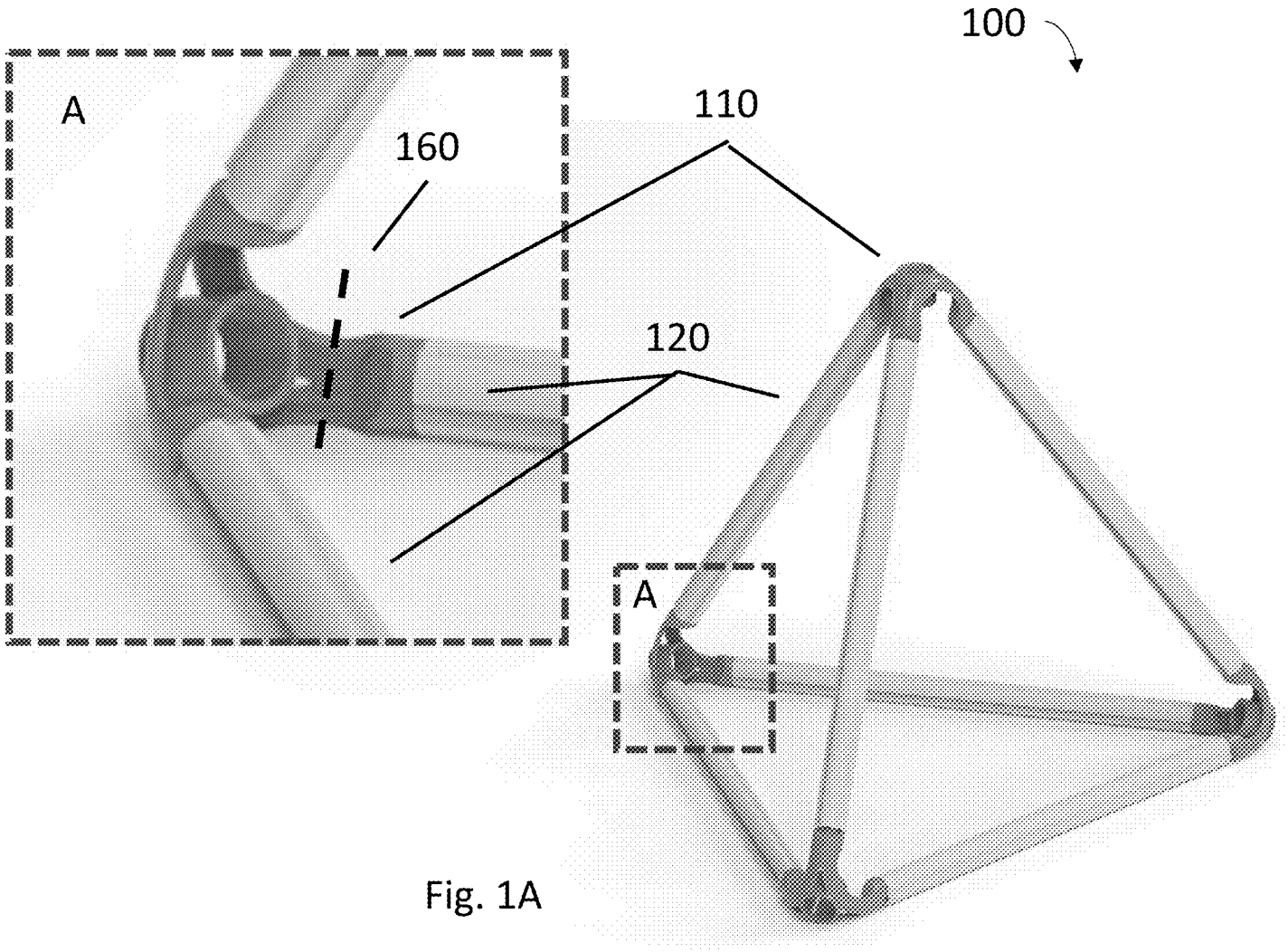
FIG. 1A depicts an orthogonal schematic diagram of a preferred embodiment of the invention.
Figure 1B:
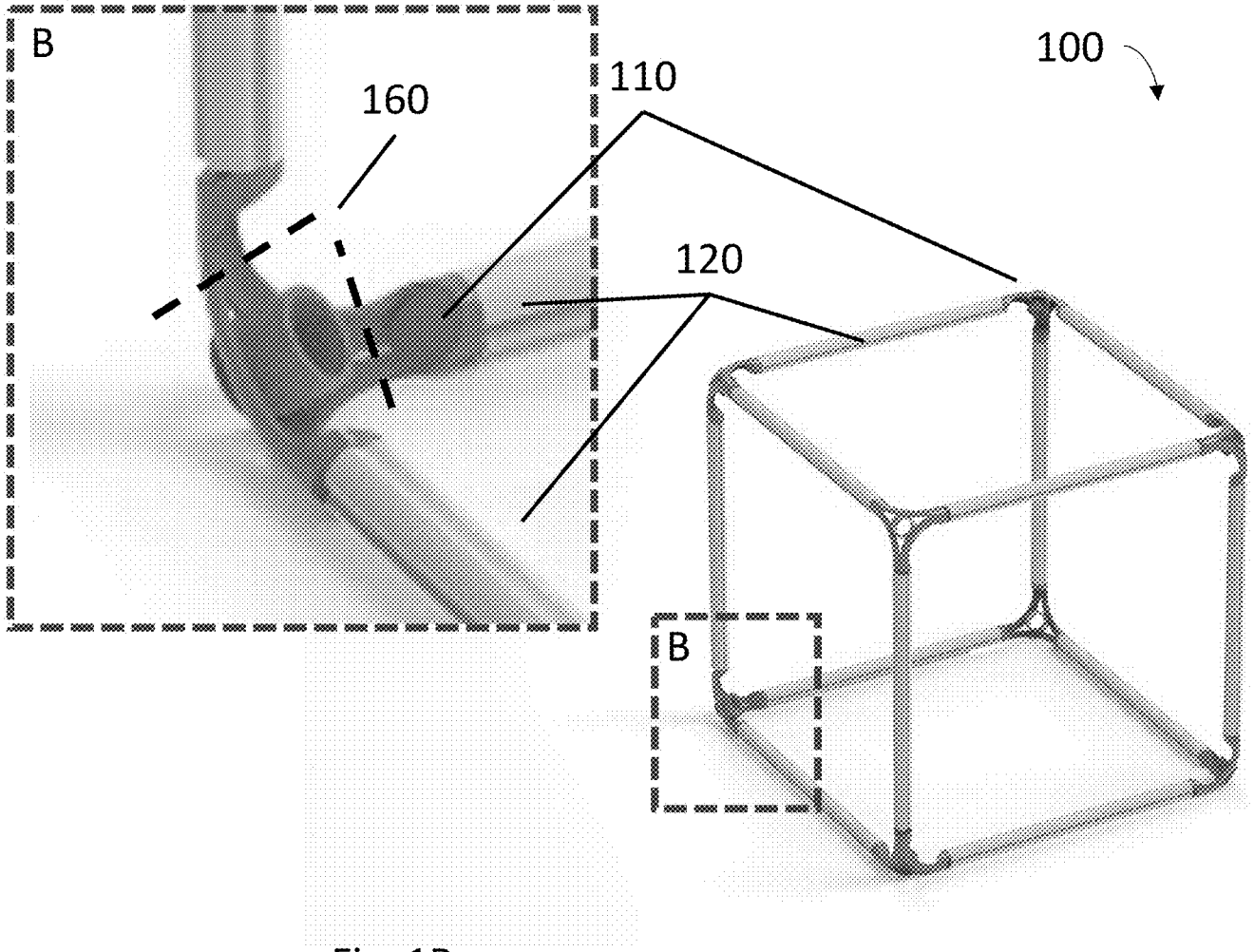
FIG. 1B depicts an orthogonal schematic diagram of another preferred embodiment of the invention.

As depicted in FIG. 1A and FIG. 1B; the inventive system and method (100) may comprise at least four flexible corner connectors (110) and corresponding in fit, at least six rods or rods (120) which when assembled by a user produces a lattice in and on which detergent solutions and other films may be deposited and supported, wherein the lattice may be configured and reconfigured for use, cleaning, and storage after use.

FIG. 1A Box A and FIG. 1B Box B depict a close-up view of a flexible corner connector (110) and corresponding rods (120) removably affixed thereon.

In certain embodiments, the rod has at least one channel portion, the at least one channel portion extending longitudinally across the rod. In certain embodiments, the rod has two channel portions, three channel portions, or four channel portions. In certain embodiments, the channel portions extend longitudinally on each side of the rod.

In certain embodiments, the flexible corner connector has a hollowed out central bore portion and three posts. In certain embodiments, the hollowed out central bore portion includes a circular center that is connected to an outer spline that is flexible. In certain embodiments, the flexible outer spline can flex around the bored circular center thus allowing the corner connector to flex and allowing the corner connector to create carious configurations with the rods, such that various shapes of bubbles are allowed to be created.

Figure 2A:
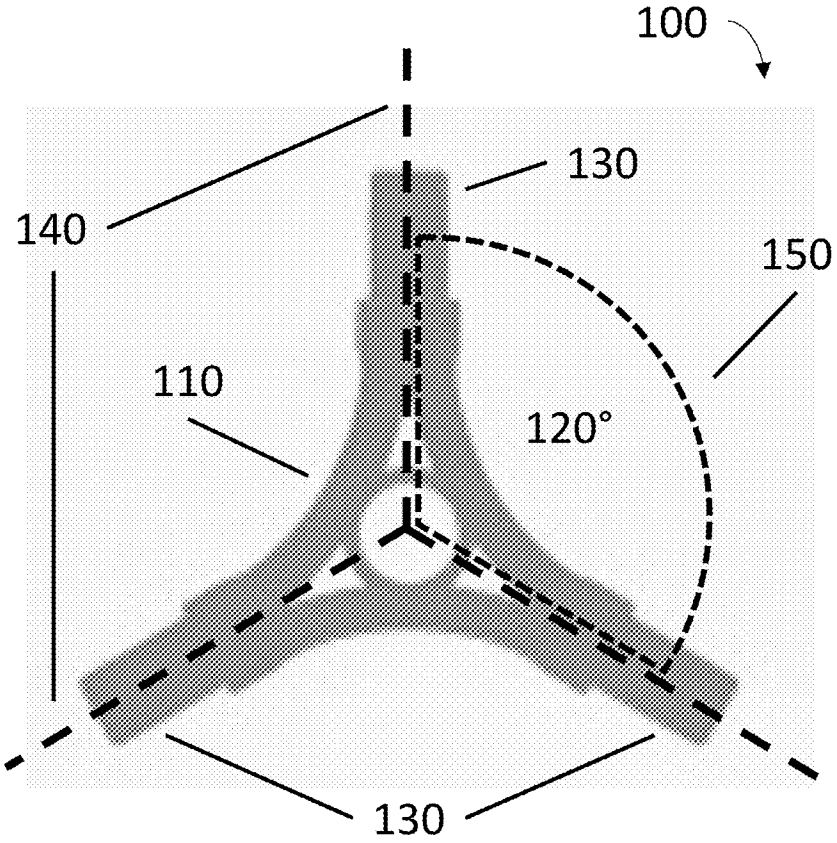
FIG. 2A depicts a top view schematic diagram of a preferred embodiment of an inventive flexible corner connector.

FIG. 2A depicts a top view of an inventive flexible corner connector (110), as if flattened on a surface, each having three posts (130), each post (130) having a longitudinal axis (140) configured approximately one-hundred-and-twenty degrees (150) from the longitudinal axis of an adjacent post (130).

Figure 2B:
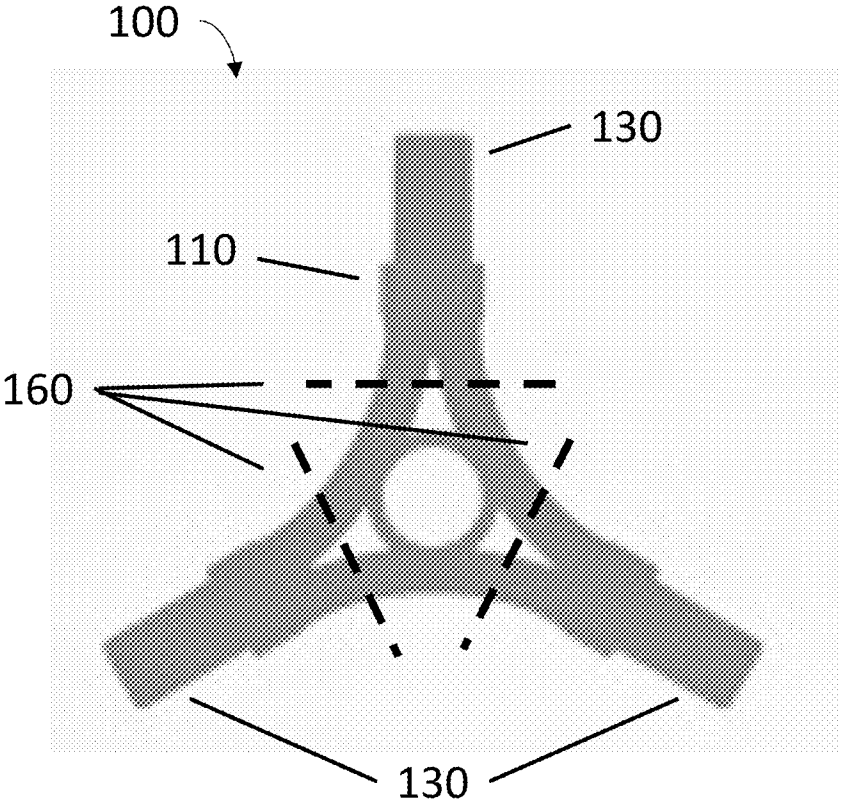
FIG. 2B depicts a top view schematic diagram of a preferred embodiment of an inventive flexible corner connector.
Figure 3:
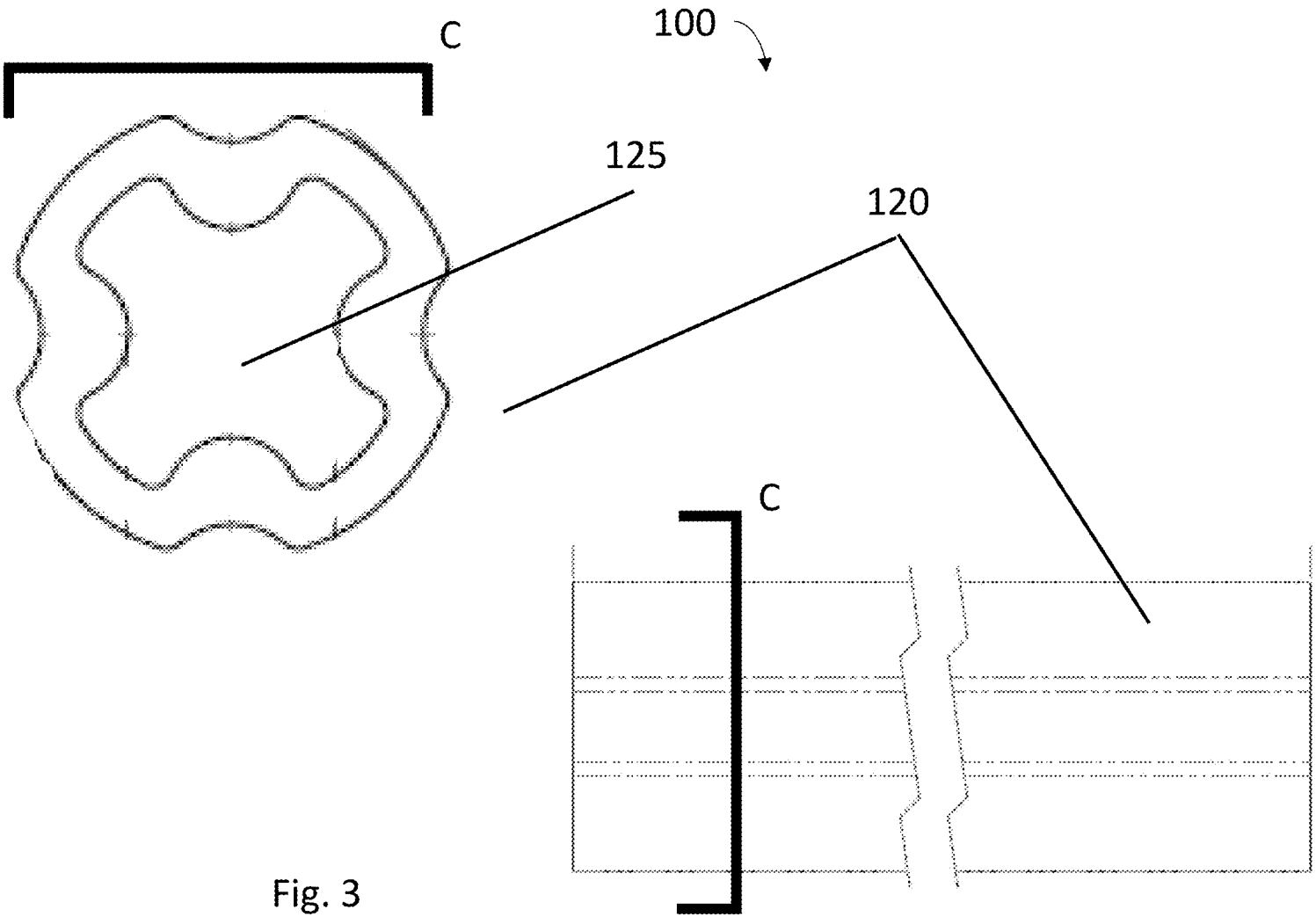
FIG. 3 depicts a side and cross-sectional view of a preferred embodiment of an inventive rod or longitudinal connector.

FIG. 2B depicts a flexible corner connector indicating approximately with dashed lines three axis of flexibility (160); as also depicted by dashed lines (160) in FIG. 1A Box A and FIG. 1B Box B FIG. 3 depicts a preferred embodiment of an inventive rod (120); including a cross-section view C depicting an opening or aperture (125) for receiving and removably securing the inventive rod (120) to an inventive flexible corner connector (110).

Figure 4:
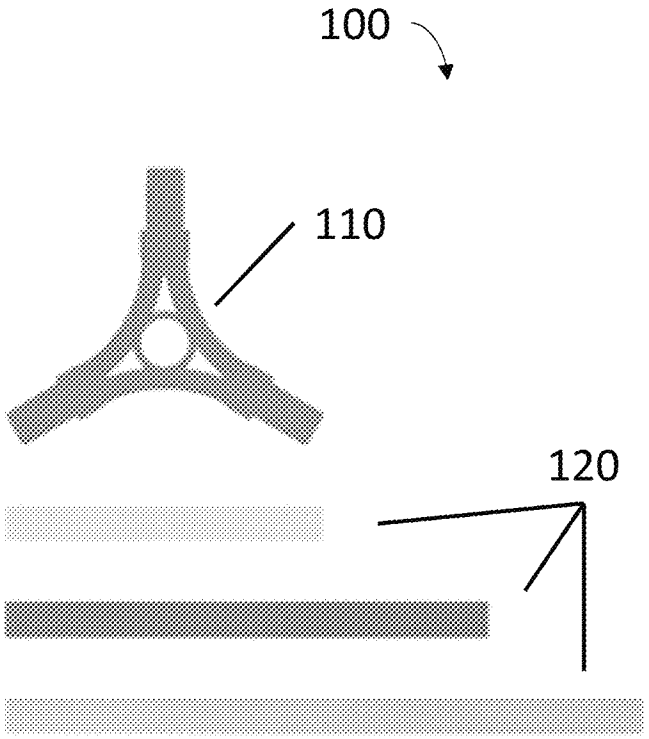
FIG. 4 depicts a elements of an inventive system, method, and kit.

FIG. 4 depicts a preferred embodiment of the inventive system, method, and kit (100) for assembling a reconfigurable lattice in and on which detergent solutions and other films may be deposited and supported.

It is contemplated in certain embodiments of the instant invention that a plurality of identical configuration corner connectors (110) and a plurality of rods or rods (120) of varying lengths are provided, as depicted in FIG. 4, in order to produce lattice of varying configurations.

Figure 5A:
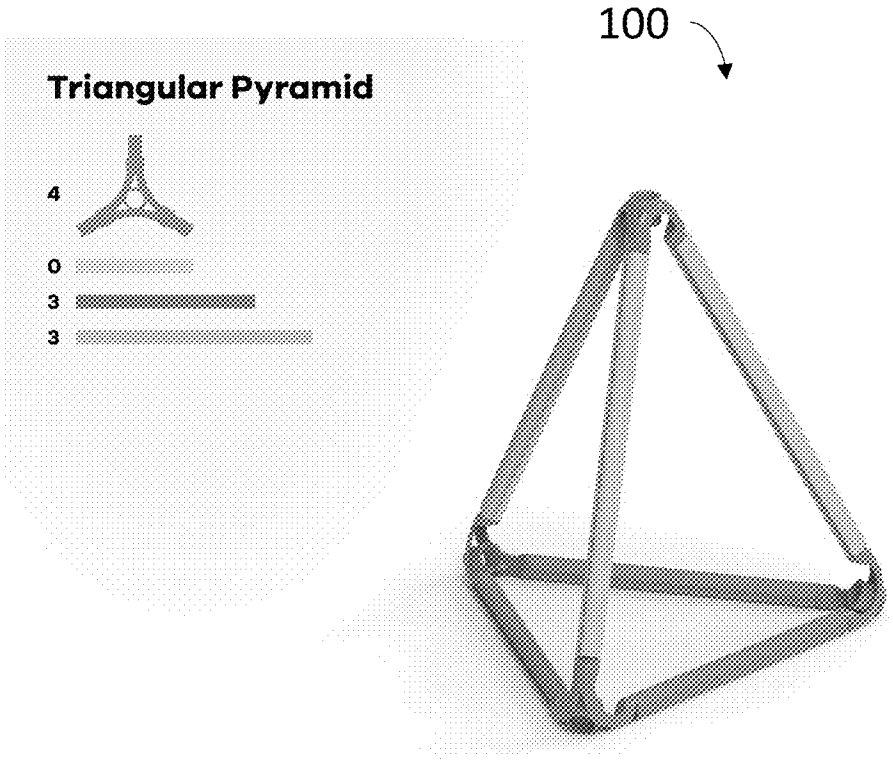
FIG. 5A-FIG. 5I depict various configurations of inventive assembled lattice.
Figure 5B:
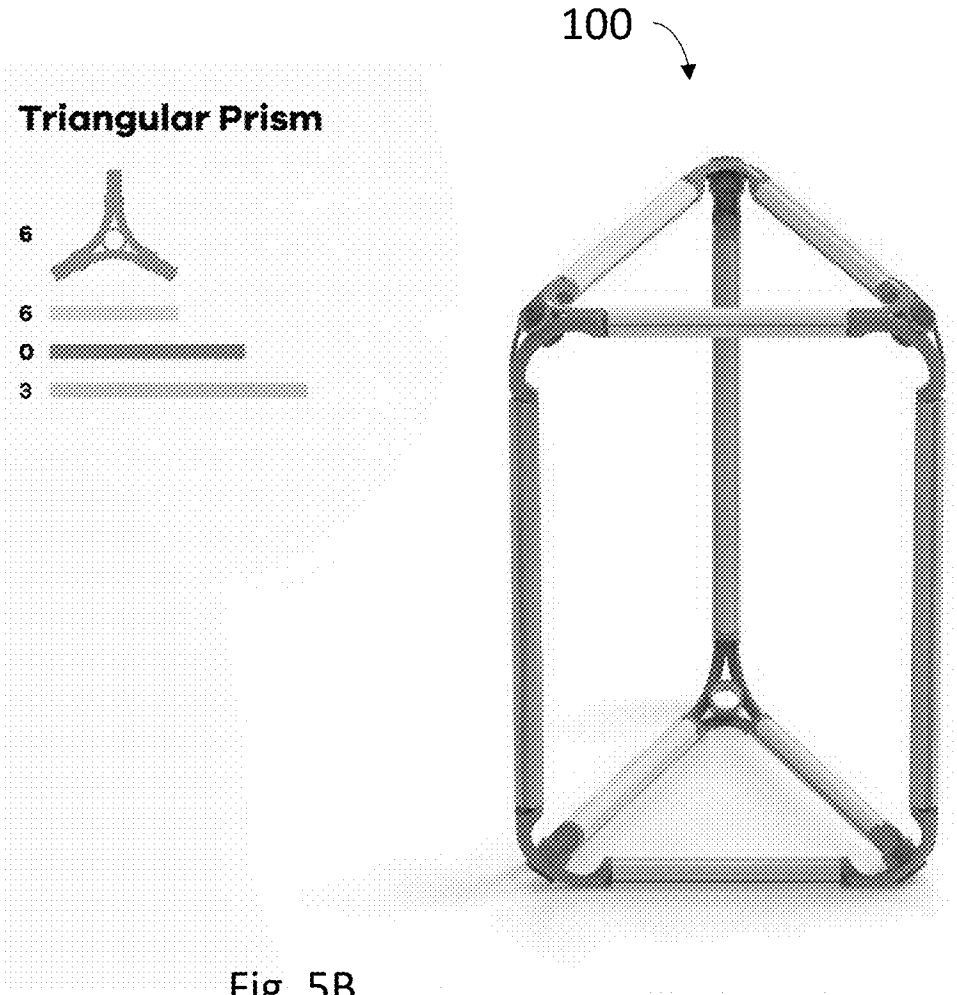
Figure 5C:
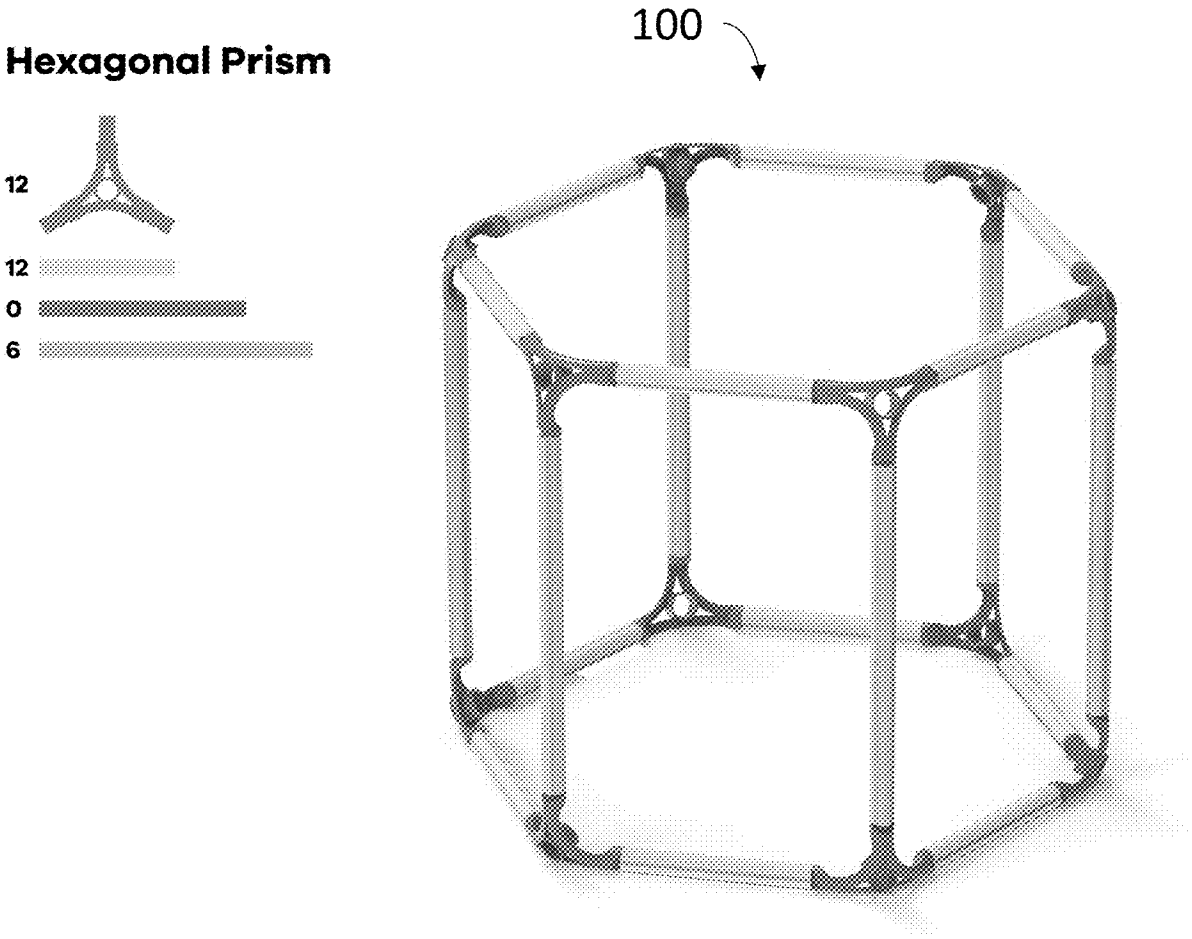
Figure 5D:
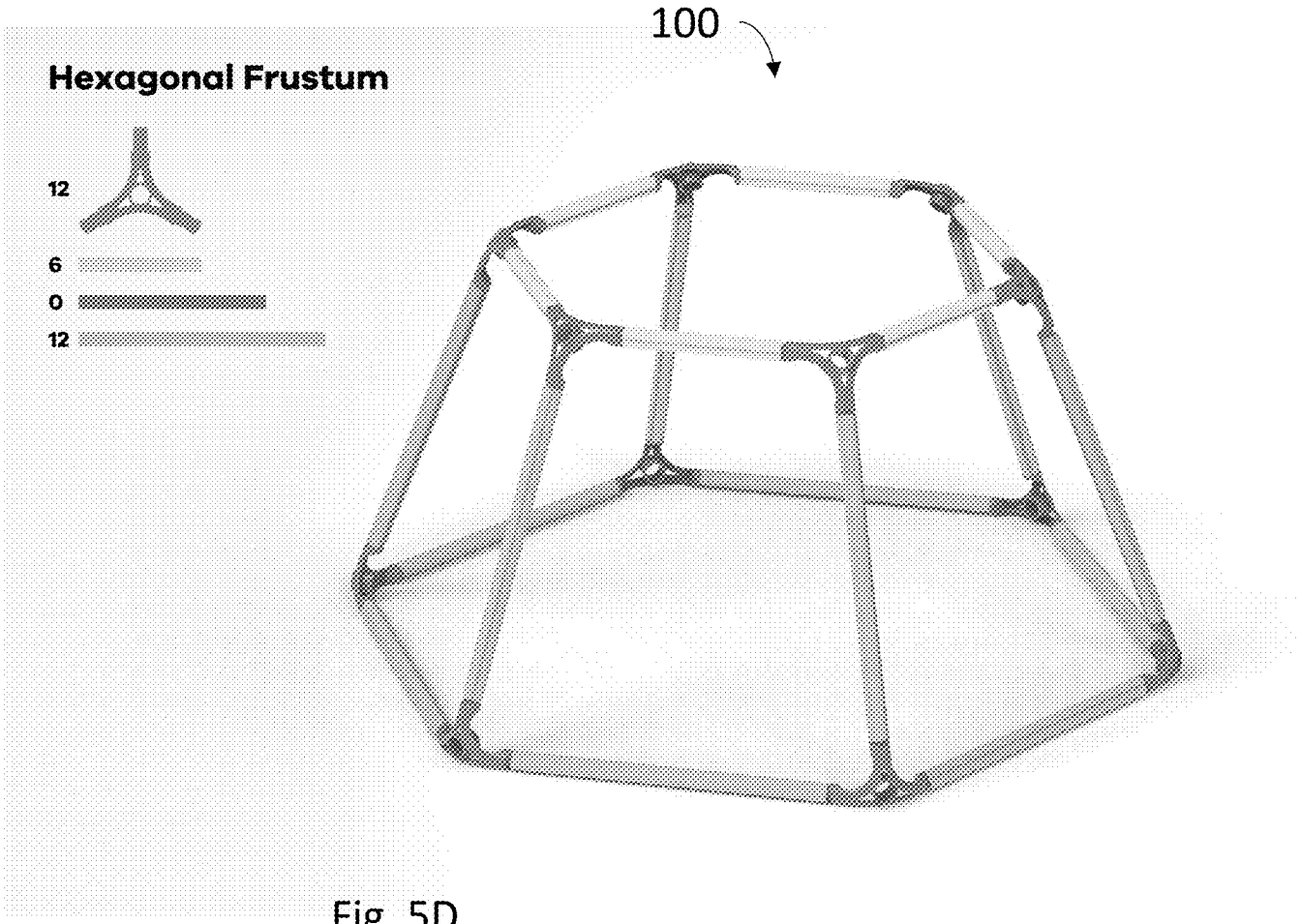
Figure 5E:
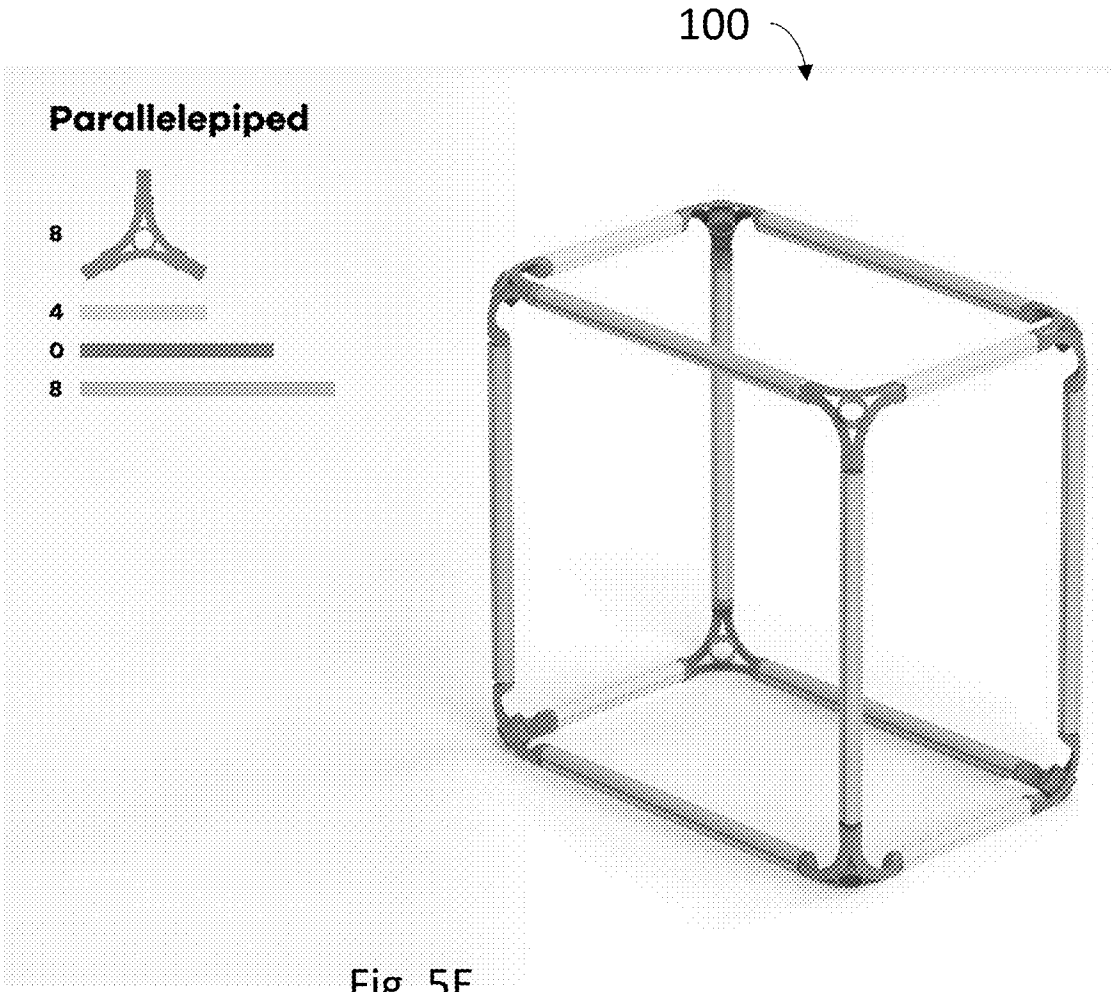
Figure 5F:
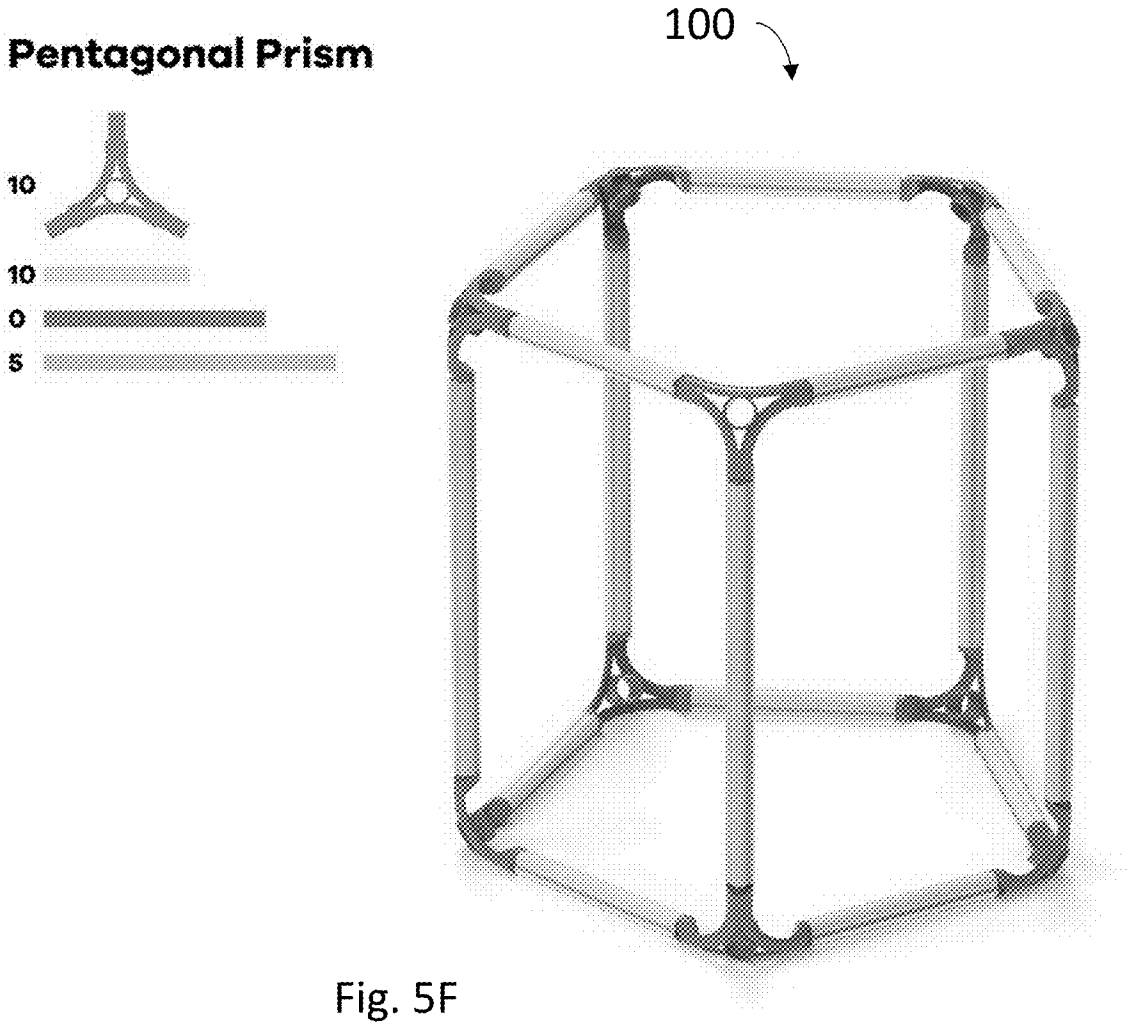
Figure 5G:
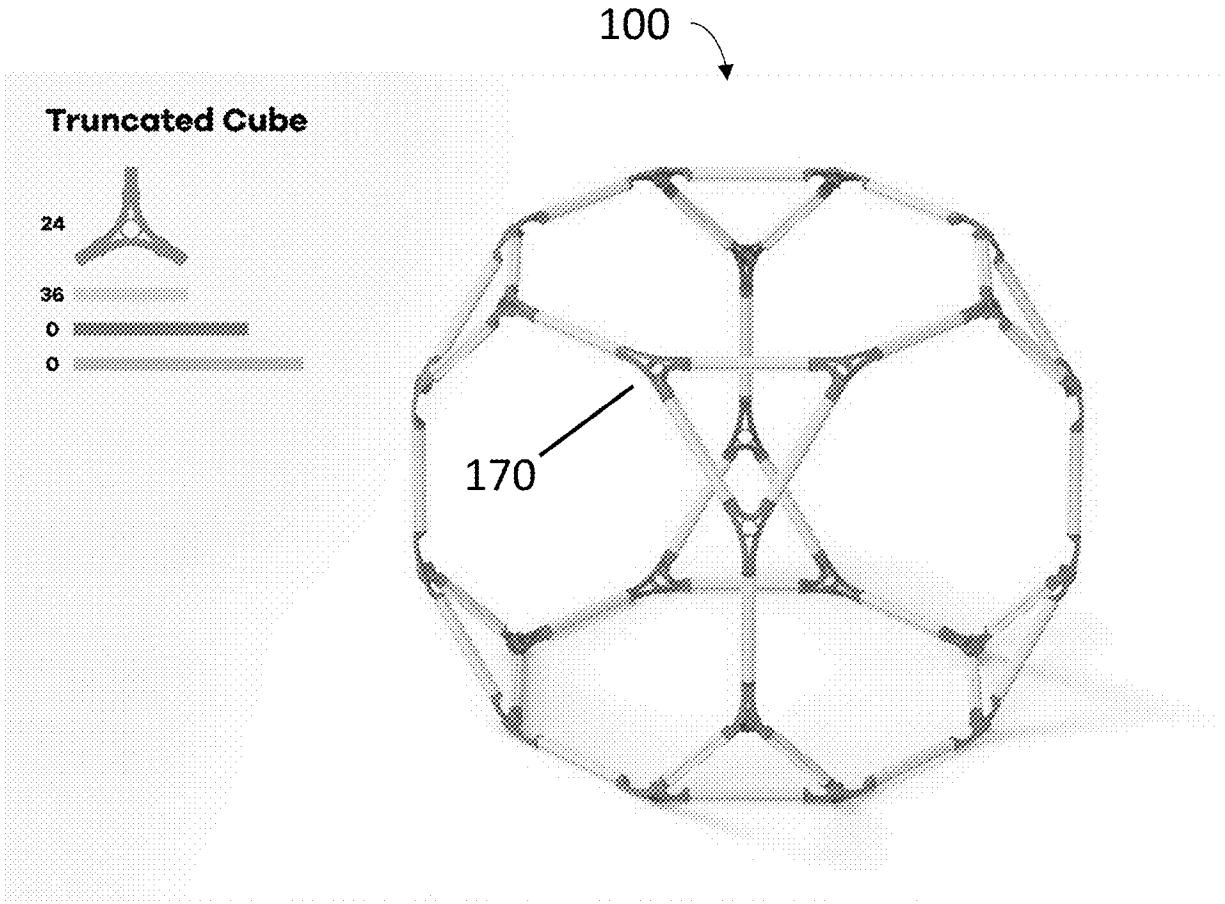
Figure 5H:
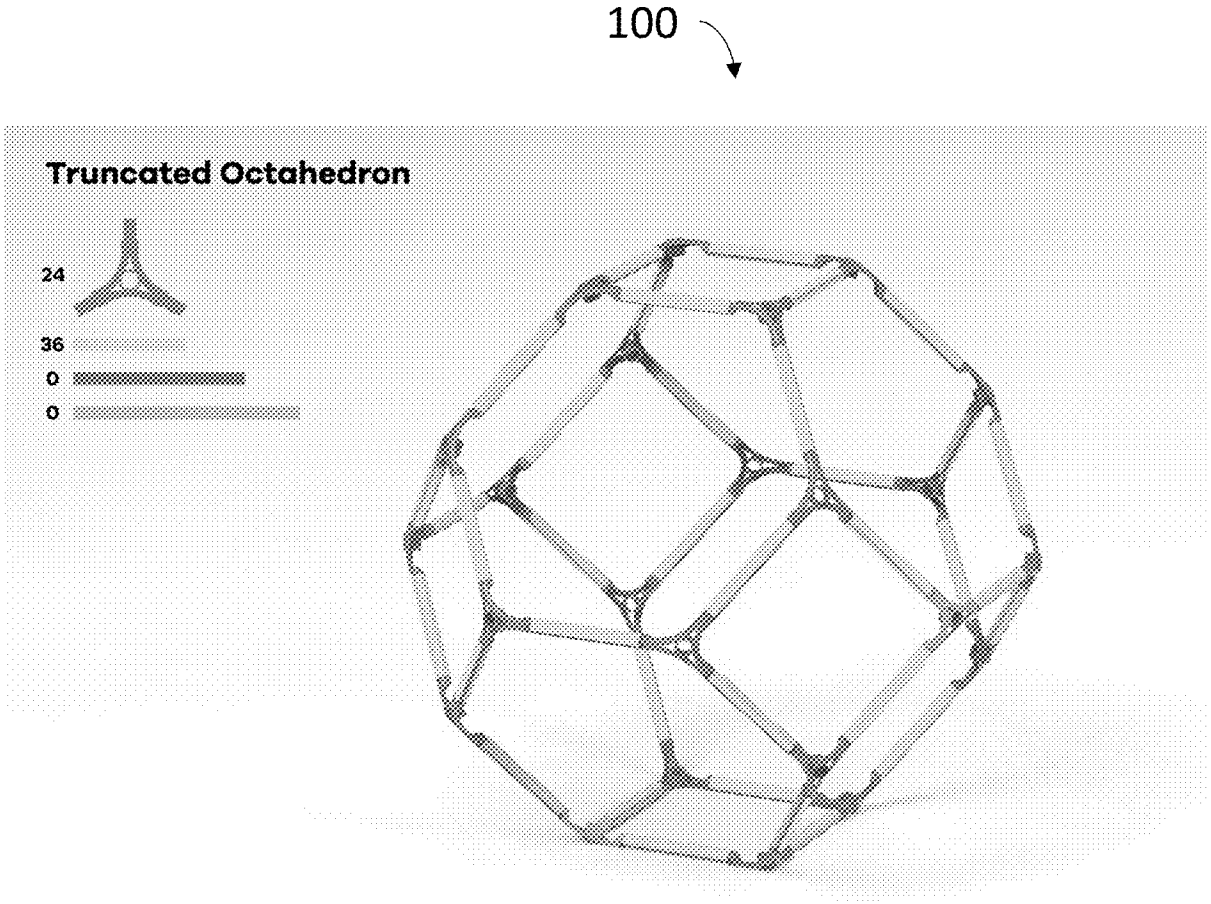
Figure 5I:
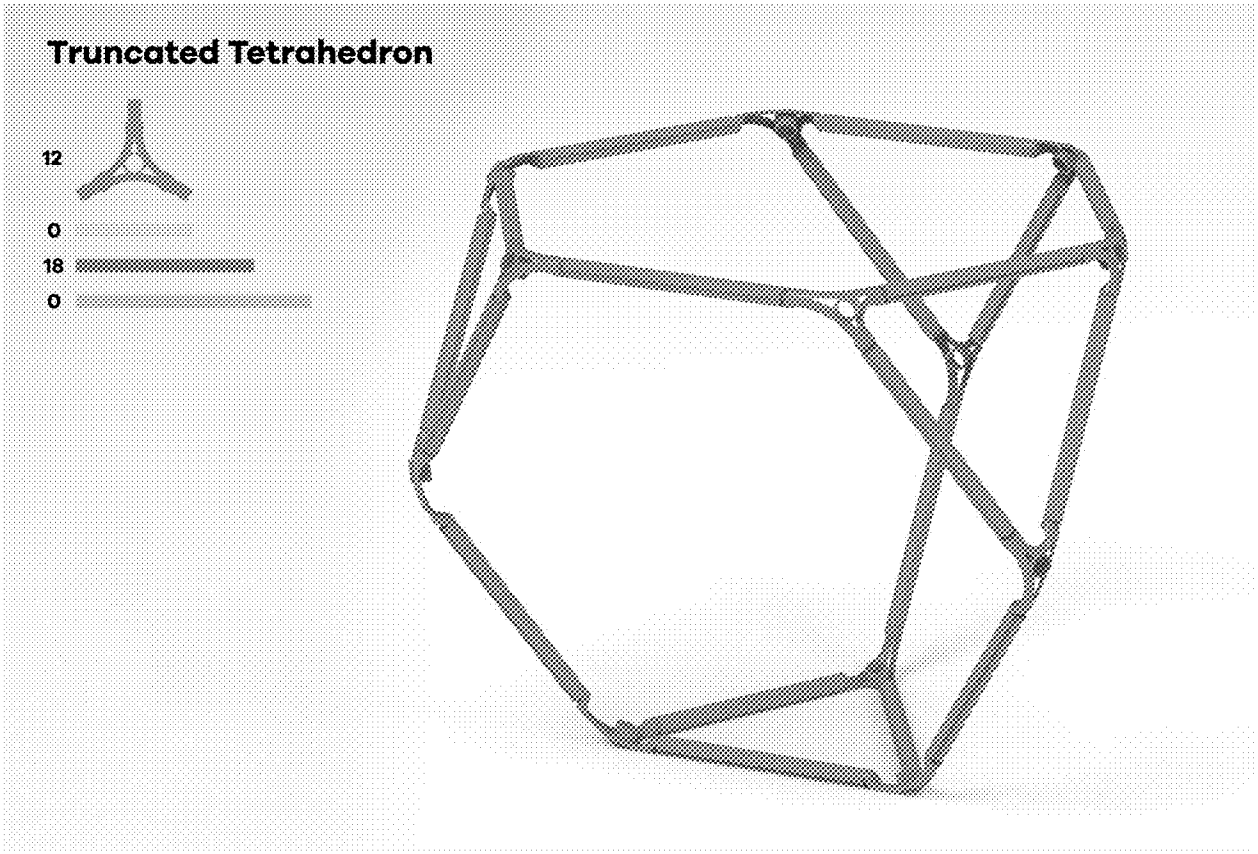

It is contemplated in certain embodiments of the instant invention that a plurality of varying configuration corner connectors (FIG. 5G, 170) and a plurality of rods or rods (120) of varying lengths are provided, as depicted in FIG. 4, in order to produce lattice of varying configurations.

It is contemplated in certain embodiments of the instant invention that with sufficient numbers of flexible corner connectors (110) and varying length rods (120) an almost inexhaustible number of configurations of lattice may be assembled as depicted by way of example and not limitation in and by FIG. 5A-FIG. 5I.

It is contemplated that the flexible corner connectors (110, 170) and rods or rods (120) be made of a plastic.

It is contemplated that the rods or rod (120) be made of a colored plastic wherein the length of the rod (120) is denoted by a different color.

Having thus described several embodiments for practicing the inventive method, its advantages and objectives can be easily understood.

Variations from the description above may and can be made by one skilled in the art without departing from the scope of the invention.

Accordingly, this invention is not to be limited by the embodiments as described, which are given by way of example only and not by way of limitation.

What is claimed is:

1. A reconfigurable three-dimensional lattice system for supporting liquid films, the system comprising;

at least six rods, each rod having an aperture at and in each opposing end, wherein each of the at least six rods has at least one channel portion, the at least one channel portion extending longitudinally across each of the six rods, and wherein the at least six rods are hollow; and at least four flexible corner connectors each having three posts, each post having a longitudinal axis and configured to be received into the aperture in and at one end of one of the at least six rods;

wherein the at least six rods and the at least four corner connectors are assembled by a user, thereby forming a three-dimensional lattice upon which a liquid film is configured to be deposited and supported.

2. The system of claim 1, wherein an at least four flexible corner connector post longitudinal axis is configured approximately one-hundred-and-twenty degrees from the longitudinal axis of an adjacent post.

3. The system of claim 1, wherein an at least four flexible corner connector post longitudinal axis is configured approximately greater than one-hundred-and-twenty degrees from the longitudinal axis of an adjacent post.

4. The system of claim 1, wherein the corner connectors and cylindrical rods comprise a plastic.

5. The system of claim 1, wherein the flexible corner connectors are identical in size and configuration and the cylindrical rods are of equal length.

6. The system of claim 1, wherein the corner connectors and rods when assembled provide a four-sided or tetrahedral shaped lattice.

7. The system of claim 1, wherein the corner connectors and rods when assembled provide a six-sided or cube shaped lattice.

8. The system of claim 1, wherein the corner connectors and rods when assembled provide a lattice of more than six sides.

9. A method of assembling a reconfigurable three-dimensional lattice system for supporting liquid films, the method comprising the steps of:

providing at least six rods, each rod having an aperture at and in each opposing end, wherein each of the at least six rods has at least one channel portion, the at least one channel portion extending longitudinally across each of the six rods, and wherein the at least six rods are hollow; and providing at least four flexible corner connectors each having three posts, each post having a longitudinal axis and configured to be received into the aperture in and at one end of one of the at least six rods;

wherein the at least six rods and the at least four corner connectors as assembled provide a three-dimensional lattice upon which a liquid film is configured to be deposited and supported.

10. The method of claim 9, wherein an at least four flexible corner connector post longitudinal axis is configured approximately one-hundred-and-twenty degrees from the longitudinal axis of an adjacent post.

11. The method of claim 9, wherein an at least four flexible corner connector post longitudinal axis is configured approximately greater than one-hundred-and-twenty degrees from the longitudinal axis of an adjacent post.

12. The method of claim 9, wherein the corner connectors and cylindrical rods comprise a plastic.

13. The method of claim 9, wherein the flexible corner connectors are identical in size and configuration and the cylindrical rods are of equal length.

14. The method of claim 9, wherein the corner connectors and rods when assembled provide a four-sided or tetrahedral shaped lattice.

15. The method of claim 9, wherein the corner connectors and rods when assembled provide a six-sided or cube shaped lattice.

16. The method of claim 9, wherein the corner connectors and rods when assembled provide a lattice of more than six sides.

17. A kit for assembling a reconfigurable three-dimensional lattice upon which a liquid film is configured to be deposited and supported, the kit comprising;

at least six rods, each rod having an aperture at and in each opposing end, wherein each of the at least six rods has at least one channel portion, the at least one channel portion extending longitudinally across each of the six rods, and wherein the at least six rods are hollow; and at least four flexible corner connectors each having three posts, each post having a longitudinal axis and configured to be received into the aperture in and at one end of one of the at least six rods;

wherein the at least six rods and the at least four corner connectors are assembled and provide a three-dimensional lattice upon which a liquid film is configured to be deposited and supported.

18. The kit of claim 17, wherein an at least four flexible corner connector post longitudinal axis is configured approximately one-hundred-and-twenty degrees from the longitudinal axis of an adjacent post.

19. The kit of claim 17, wherein an at least four flexible corner connector post longitudinal axis is configured approximately greater than one-hundred-and-twenty degrees from the longitudinal axis of an adjacent post.

* * * * *